United States Patent [19]

Kiser

[11] 4,338,749

[45] Jul. 13, 1982

[54] TOOLHOLDER

[76] Inventor: Robert E. Kiser, 58770 Rd. 601, Ahwahnee, Calif. 93601

[21] Appl. No.: 170,915

[22] Filed: Jul. 21, 1980

[51] Int. Cl.[3] ..... B24B 3/34

[52] U.S. Cl. ..... 51/220

[58] Field of Search ..... 51/219 R, 220, 221, 51/218 A, 218 R, 217 R, 217 A

[56] References Cited

U.S. PATENT DOCUMENTS

| | | | |
|---|---|---|---|
| 1,659,257 | 2/1928 | Giampeter | 51/218 A |
| 2,384,256 | 9/1945 | Jearim | 51/220 |
| 2,455,562 | 12/1948 | Crowther | 51/219 R |
| 2,604,738 | 7/1952 | Ramey | 51/221 R |
| 2,733,559 | 2/1956 | Staudt | 51/220 |
| 3,411,249 | 11/1968 | Tidwell | 51/220 |

*Primary Examiner*—Harold D. Whitehead
*Attorney, Agent, or Firm*—Huebner & Worrel

[57] ABSTRACT

A toolholder for use in shaping the blade of a screwdriver with a grinder having a grinding wheel and a guiding surface parallel to the axis of the wheel, the toolholder including a pair of blocks adapted to clamp the shank of the screwdriver between them, each block providing a guiding surface angularly related to the shank and disposed oppositely of the other block; clamps spaced along the axis to draw the block onto the shank and selectively adjustable to bring the guided surfaces into normal relation with a plane normal to the axis; and a pair of projections on the blocks bearing indicia indicating the relative spacing of their ends when the guided surfaces are in such normal relation, the toolholder being guided by engagement of one of the guided surfaces with the guiding surface to shape one side of the blade and being invertible with the screwdriver for guidance of the toolholder by engagement of the other of the guided surfaces by the guiding surface to shape the other side of the blade.

7 Claims, 7 Drawing Figures

Fig. 1
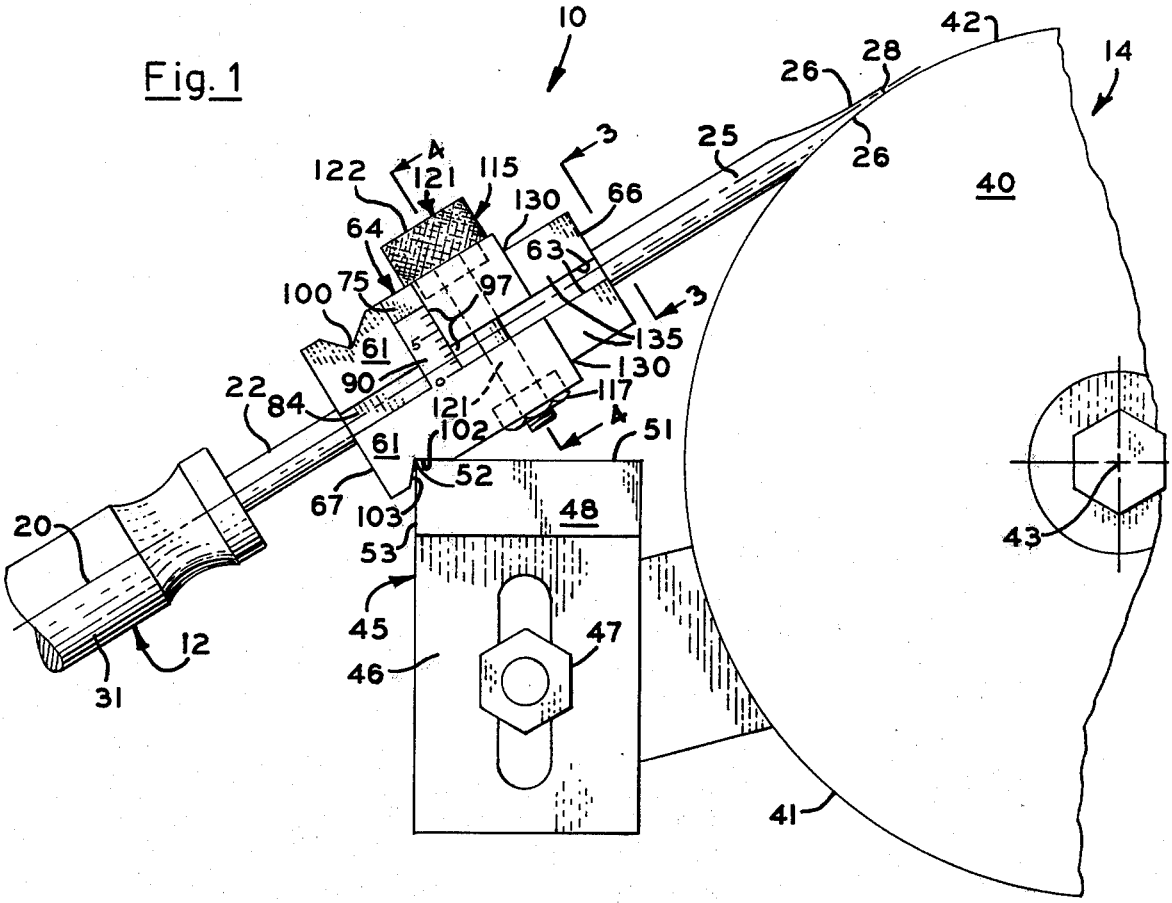
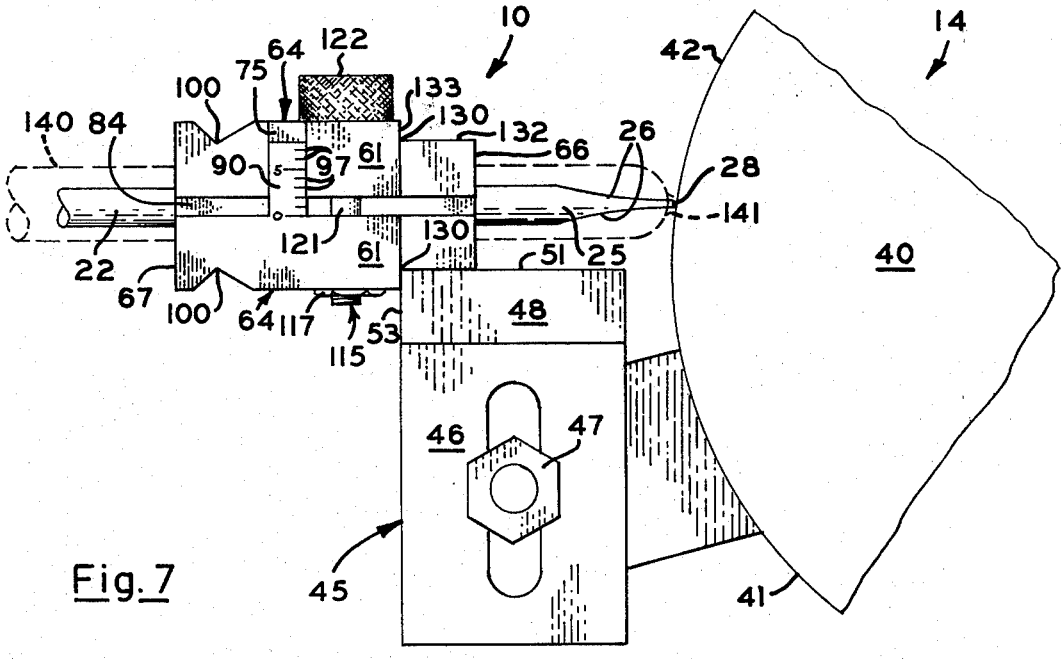
Fig. 7

Fig. 2
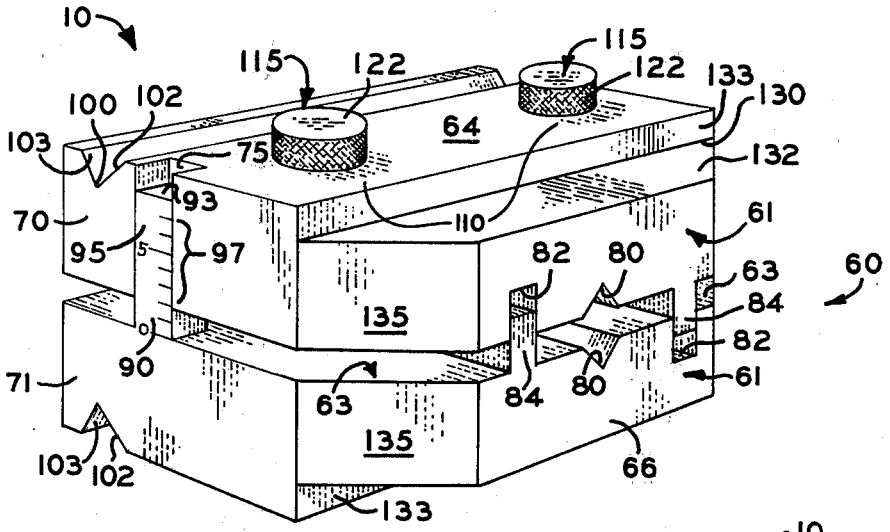
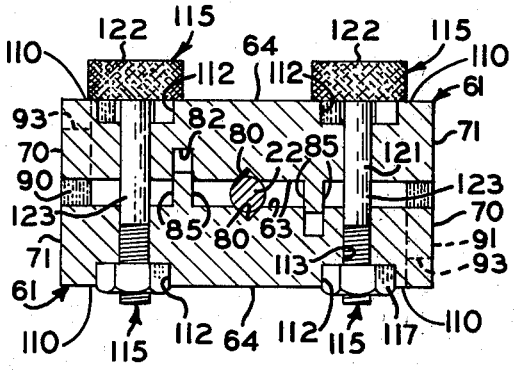
Fig. 4
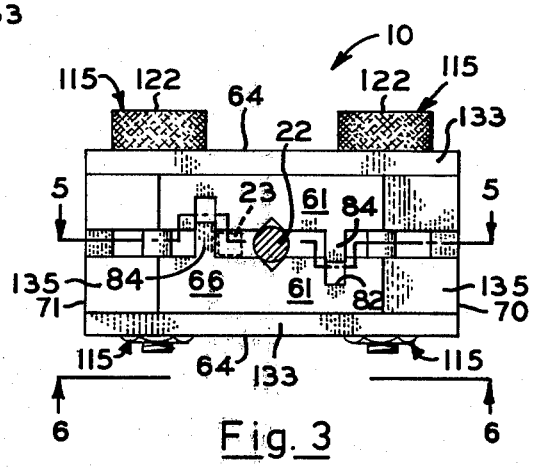
Fig. 3
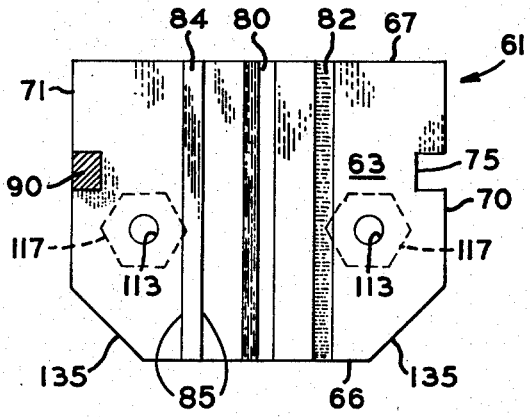
Fig. 5
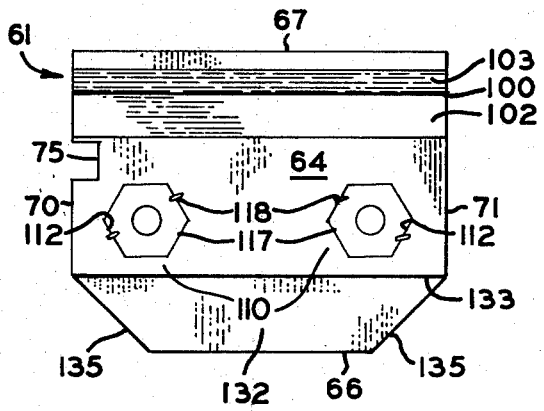
Fig. 6

TOOLHOLDER

BACKGROUND OF THE INVENTION

1. Field of the Invention

The present invention relates to a toolholder, and more specifically to a toolholder for use in precisely shaping the screw-engaging portion of a screwdriver or the like in a hollow-ground configuration with a grinder.

2. Description of the Prior Art

It is well known that the most advantageous shape for a screwdriver blade adapted to engage a screwhead having a single transverse slot is a shape in which opposite sides of the blade are "hollow ground"; that is, where these sides are cylindrically concave. However, screwdrivers having such a shape are relatively expensive due to the difficulties in accurately producing such a shape. The cylindrical periphery of the grinding wheel of a conventional grinder is, of course, adapted to produce a hollow-ground shape when the side of the blade is applied to the wheel. However, despite the presence of a tool rest adjacent to the wheel in many grinders, extreme care is required in manually guiding a screwdriver to produce an accurately and symmetrically hollow-ground blade of a relatively large screwdriver, and it is almost impossible with manual guidance to form an effective hollow-ground blade on a small screwdriver.

It has been recognized, therefore, to be highly advantageous to provide a relatively inexpensive toolholder which guides a screwdriver for grinding by a bench grinder or the like so as to form both sides of the blade of the screwdriver in a substantially identical hollow-ground configuration.

PRIOR ART STATEMENT

Characterizing the closest prior art of which the applicant is aware and in conformance with 37 C.F.R. §1.97 and §1.98, attention is invited to U.S. Pat. No. 2,604,738 to Ramey, issued July 29, 1952, a copy of which is enclosed.

This patent is believed relevant in its disclosure of a toolholder which engages a screwdriver for grinding its blade by movement together of the toolholder and the screwdriver, this movement being guided by a planar surface of the toolholder and the toolholder and screwdriver being rotated 180° to grind opposite sides of the blade.

SUMMRY OF THE INVENTION

It is an object of the present invention to provide an improved toolholder for use in shaping the opposite sides of a screwdriver blade or the like in a hollow-ground configuration.

Another object is to provide such a toolholder which is relatively inexpensive and which is adapted for use with a conventional bench grinder, being guided by the usual tool rest provided with such a grinder.

Another object is to provide such a toolholder which has no wearing parts which move relatively while the blade is shaped.

Another object is to provide such a toolholder which guides the screwdriver so that the sides of the blade are each given a substantially identical, cylindrically-concave shape.

Another object is to provide such a toolholder which also guides the screwdriver to shape a tip surface thereof interconnecting the hollow-ground sides.

Another object is to provide such a toolholder adapted for use with screwdrivers of a wide range of sizes and for use with screwdrivers having shanks of a wide range of lengths and a variety of transverse cross-sectional configurations.

Another object is to provide such a toolholder which accurately guides a tool for dressing the wheel of a grinder usable with the holder for shaping screwdriver blades.

A further object is to provide improved elements and arrangements thereof in a toolholder for use in forming hollow-ground screwdriver blades which is durable, convenient to use, and fully effective in accomplishing its intended purposes.

BRIEF DESCRIPTION OF THE DRAWINGS

FIG. 1 is a side elevation of a toolholder embodying the principles of the present invention guiding a fragmentarily represented screwdriver with a side of the blade thereof being shaped by a fragmentarily represented grinder.

FIG. 2 is a somewhat enlarged perspective view of the toolholder of FIG. 1.

FIG. 3 is an elevation of the holder taken from the position of line 3—3 of FIG. 1 with an alternate form of screwdriver shank shown in dash lines.

FIG. 4 is a longitudinal section of the toolholder taken on line 4—4 of FIG. 1.

FIG. 5 is a plan view of a face of a block used in the toolholder taken from the position of line 5—5 of FIG. 3.

FIG. 6 is a plan view of a face of the block opposite the face shown in FIG. 5.

FIG. 7 is an elevation similar to FIG. 1 with a tip surface of the blade being shaped and with a wheel dressing tool depicted in dash lines.

DESCRIPTION OF THE PREFERRED EMBODIMENT

Referring with greater particularity to the drawings, a toolholder 10 which embodies the principles of the present invention is best shown in FIGS. 1 through 4. The toolholder is shown in FIG. 1 in a representative operating environment which includes a fragmentarily represented screwdriver 12 and a shaping device or grinder 14.

The screwdriver 12 is of conventional construction having a longitudinal axis 21 and a central shank 22 extended longitudinally therealong. The shank is depicted as having a circular cross-section as best shown in FIG. 3. However, the toolholder 10 is adapted for use with a shank of square cross-section, as shown in dash lines and indicated by the numeral 23, the square shank having opposite parallel planar surfaces parallel to its longitudinal axis. The screwdriver has a blade 25 integrally constructed with the shank and mounted at one end thereof. The blade is adapted for driving engagement with a screw head of well-known form having a single transverse slot of rectangular cross-section. The blade has a pair of opposite sides 26 which are of substantially identical configuration and are disposed symmetrically oppositely of the longitudinal axis. The sides of the blade thus are disposed at the end of the screwdriver. As will subsequently be described, these sides are "hollow ground"; that is, they are cylindrically concave. The blade terminates at a longitudinal end or tip surface 28 which is substantially normal to the longitudinal axis. The tip surface interconnects the sides of the blade and they converge to this surface. The screwdriver includes a fragmentarily represented handle 31.

The grinder 14 is a bench grinder of conventional construction and has a tool-shaping element or grinding wheel 40 having a cylindrical periphery 41 providing circular edges 42 and mounted for rotation about a generally horizontal rotational axis 43 which is substantially coincident with the axis of the wheel. The grinder includes an L-shaped tool rest 45 mounted at one side of the wheel. One arm 46 of the rest is provided with a vertical slot through which a bolt assembly 47 extends parallel to the axis in clamping relation to this arm. The rest is thus mounted for positioning vertically and angularly in relation to the wheel. The other arm 48 of the rest is planar and extends generally horizontally and parallel to the rotational axis in adjacent relation to the wheel. This arm provides an upwardly disposed, substantially planar, rectangular guiding surface 51 which is substantially parallel to the rotational axis and has an edge 52 disposed parallel to and oppositely of the wheel. This other arm provides a horizontally elongated, generally vertical planar stop surface 53 extended downwardly from the edge in substantially parallel relation to the rotational axis. The stop surface is thus disposed in substantially right-angular relation to the first guiding surface and oppositely of the guiding surface from the wheel.

The toolholder 10 has a body 60 formed by two substantially identical blocks 61 disposed in juxtaposed, facing relation. Preferably, each block is of unitary, die-cast construction. The blocks are of somewhat elongated, generally rectangular shape. Each block has a first planar face 63 which is disposed toward the other block in facing relation thereto and an opposite substantially parallel, second planar face 64 which is disposed away from the other block. The second faces are thus a pair of opposite faces of the body which are borne individually by the blocks. Each block has a first transverse side 66 which is disposed toward the grinding wheel 40 when the toolholder is in use, and an opposite transverse side 67.

Each block 61 has a pair of longitudinally opposite planar ends 70 and 71. The end 70 is provided with a substantially square notch 75 extending through it normally between the faces 63 and 64 and spaced somewhat closer to the second transverse side 67 of the blocks than to its first transverse side 66.

The first face 63 of each block 61 is provided with a V-shaped groove 80 which is longitudinally centered in the block and extends entirely across this face between the transverse sides 66 and 67 in right-angular relation to them. Each block is provided with a rectangular groove 82 and an integral projection or rib 84. This groove and the rib are of slidably mating, rectangular cross-sectional configuration and extend parallel to the V-shaped groove in oppositely and equally spaced relation thereto. The rib is extended from the first face toward the other block and has a pair of opposite, longitudinally facing planar surfaces 85. Since the blocks are substantially identical, when they are disposed in facing relation the V-shaped grooves are aligned in facing relation and the rib of each block is slidably engaged in the rectangular groove of the other block. The engagement of the ribs and rectangular grooves constrains the blocks against relative longitudinal movement and thereby maintains the blocks in juxtaposed relation longitudinally with the end 70 of each block adjacent to the end 71 of the other block.

The toolholder 10 is provided with a first measuring projection 90 which is fixedly mounted on one of the blocks 61 and with a substantially identical, second measuring projection 91 fixedly mounted on the other of the blocks. The projections are individually mounted on the ends 71 of the corresponding blocks, and are integrally constructed therewith. The end of the block bearing the second projection is thus oppositely disposed longitudinally of the blocks from the end bearing the first projection when the first faces 63 are in facing relation. Each projection extends from its respective block toward the other block and is disposed so as to be received in the notch 75 thereof. Each projection is of square cross section and is slidably fitted in the corresponding notch, the projection extending from the first face 63 of its block to a planar end 93 parallel to this face and spaced therefrom a distance substantially equal to the distance between the first face and the second face 64 of each block. Each projection has a planar face 95 which is substantially coplanar with the corresponding end 71 and bears indicia 97 indicating the distance perpendicularly from the first face of its block to the first face of the other block. The point at which the first face of the other block is disposed along the projection thus indicates on the indicia the relative spacing of the first faces of the blocks at the adjacent pair of the ends 70 and 71 corresponding to the projection.

The second face 64 of each block 61 is provided with a generally V-shaped channel 100 extended longitudinally of the block between its ends 70 and 71 and disposed between its notch 75 and its second transverse side 67. The channel provides a planar guided surface 102 disposed toward the first transverse side 66 and an opposite planar surface 103 disposed toward the second side. These surfaces of the channel are rectangular and are elongated longitudinally of the blocks; the dimensions of the channel are thus substantially constant throughout its length. The acute angle between the planar surface of the second face and the guided surface is substantially 30° and the corresponding angle between this second face and the opposite surface is substantially 45°. When the blocks are disposed in juxtaposed relation, the planes defined by the guided surfaces are thus disposed so as to converge in a direction away from the first sides and intersect in acute-angular relation. When the adjacent pairs of the ends 70 and 71 of the blocks are equally spaced, as indicated by the indicia 97, the planes of the guided surfaces are normal to a plane of reference extending through the blocks in a direction transversely thereof since the blocks are substantially identical and the channels have constant dimensions. The planes of the guided surfaces thus intersect in substantially equal-angular relation to another reference plane disposed parallel to and centered between the first faces 63 of the block.

Each block 61 has a pair of end portions 110 disposed outwardly of its rectangular groove 82 and rib 84 between the V-shaped channel 100 and the first transverse side 66. These portions are thus spaced longitudinally of the blocks and its guided surface 102 and are disposed oppositely of the V-shaped groove 80 in individually adjacent relation to the ends 70 and 71 of the block. Each end portion is provided with a hexagonal socket 112 extended therein from the second face 64 and with a bore 113 extended in a direction normal to this face from the center of the socket to the first face 63. Since the blocks are substantially identical, the pair of these bores in each adjacent pair of ends 70 and 71 of the blocks are aligned and, together with the associated sockets, provide an opening extended through the body 60 between the first faces.

The toolholder 10 has a pair of clamps, each indicated generally by the numeral 115 and individually related to a pair of end portions 110 associated with a longitudinally adjacent pair of ends 70 and 71. Each clamp includes a hexagonal, internally screw-threaded nut 117 of the usual construction fitted in one of the sockets 112. The nut, preferably, is secured in the socket by staking as indicated by the numeral 118. The nuts of both clamps are fitted in the sockets of one of the block, the sockets of the other of the blocks being empty. Each clamp includes a thumbscrew 121 having a knurled head 122 and a screw-threaded shank 123. The head is disposed oppositely of the one of the blocks having the empty sockets from the other blocks. The diameter of the head is sufficient for it to engage the adjacent end portion of the one block outwardly of the corresponding empty socket. The shank extends through this socket and the corresponding pair of aligned bores 113 into screw-threaded engagement with the nut so that the shank is screw-threadably connected to this other of the blocks and connects the adjacent end portions of the blocks. With the described structure, rotation of the thumbscrew in a direction which moves the head toward the blocks draws these end portions together and draws the blocks together into clamping relation with any object disposed between their first faces 63.

Since the clamps 115 are spaced longitudinally of the blocks 61 and of the guided surfaces 102, selective rotation of one of the thumbscrews 121 when its head 122 is engaged with the adjacent one of the end portions 110 brings the pair of the end portions connected by the one thumbscrew somewhat closer together than the pair of the end portions connected by the other thumbscrew. Each thumbscrew thus adjustably positions the corresponding pair of ends 70 and 71 toward and from each other. The relative spacing of the pair of portions associated with each thumbscrew is indicated by the indicia 97 of the adjacent projection 90 or 91. Since the blocks are substantially identical, their faces 63 and 64 are substantially parallel when the distances between the adjacent pairs of ends 70 and 71 are equal as indicated by the indicia, and the pairs of the end portions 110 associated individually with the thumbscrews are then equally spaced.

Each block 61 is provided with a step 130 extending longitudinally across it at the intersection of its second face 64 and its first transverse side 66. The step is disposed toward this side from the thumbscrews and provides a first surface 132 and a second surface 133. These surfaces are disposed in right-angular relation, with the first surfaces being parallel to the second face and the second surface facing the first transverse side in parallel relation thereto. The first and second surfaces are, therefore, normal to a plane of reference to which the guided surfaces 102 are disposed in normal relation when the adjacent ends 70 and 71 are equally spaced.

The corners of each block 61 where its first transverse side 66 intersects, respectively, its ends 70 and 71 are beveled at an angle of approximately 45° as indicated by the numeral 135.

OPERATION

The operation of the described embodiment of the present invention is believed to be clearly apparent and is briefly summarized at this point. Initially, the thumbscrews 121 are loosened sufficiently to allow insertion of the shank 22 of the screwdriver 12 between the first faces 63 of the blocks 61. The screwdriver is then disposed, as shown in FIGS. 1, 3, and 4, with the axis 20 extending transversely of the blocks, with the shank received centrally longitudinally thereof, and with the blade 25 extended transversely from the blocks at their first transverse sides 66 so that these sides are disposed toward the blade.

If the shank 22 is square, as depicted in dash lines 23 in FIG. 3, one side of the shank is flatly engaged with the centrally disposed surface 85 of one of the ribs 84. If the shank is cylindrical or is polygonal, other than square, it is extended through the V-shaped grooves 70. The surface or the grooves, as the case may be, thus align the longitudinal axis 20 of the screwdriver precisely transversely of the blocks 61 with the second surfaces 133 of the steps 130 substantially normal to this axis. If the shank is square, it is engaged with a rib as just described, and the sides 26 of the blade 25 will individually face the second faces 64 of the blocks when one of the appropriate opposite surfaces of the shank is flatly engaged with the rib. If the shank is not square, the screwdriver is rotated until the sides 26 of the blade 25 individually face the second faces 64 of the blocks. When these manipulations described in this paragraph are completed, the shank is received in the blocks centrally between the thumbscrews 121 with the second faces of the block individually corresponding to the sides of the blade.

The screwdriver 12 is then moved in a direction along the axis 20 between the first faces 63 of the blocks 61 to the position relative thereto shown in FIG. 1. When in this position with the guided surface 102 of one of the first faces 63 flatly engaged with the guiding surface 51 and with the corresponding surface 103 engaged with the stop surface 53, the toolholder 10 is spaced from the wheel 40 a distance such that the side 26 corresponding to the one first face engages the periphery 41 to the extent required for grinding this side into a hollow-ground configuration conforming to the periphery. When these surfaces are so engaged, they are parallel to the rotational axis 43 and the respective ends 70 and 71 of the blocks are spaced in a direction along this axis.

The thumbscrews 121 are next tightened sufficiently to engage their heads 122 with the adjacent one of the second faces 64 and to draw the blocks 61 into clamping relation with the shank 22. As the blocks move toward each other into clamping relation with the shank, the measuring projections 90 and 91 slide within their corresponding notches 75. When the blocks are in this relation, the screwdriver is disposed centrally between the second faces and is engaged between the first faces 63 and each rib 84 extends into the mating one of the rectangular grooves 82. The engagement of the ribs and grooves prevents relative movement of the blocks in a direction longitudinally thereof and, therefore, in a direction along the rotational axis 43 when the surfaces 102 and 103 are engaged with the rest 45, as described.

The thumbscrews 121 are then selectively rotated to bring the first faces 63 into parallel relation. This relation is achieved when the indicia 97 indicate that the spacing of these faces are equal at each of the measuring projections 90 and 91. As previously described, when these faces are parallel, the guided surfaces 102, the surface 103, and the first surfaces 132 and the second surfaces 133 of the step 130 are normal to a plane of reference which includes the longitudinal axis 20 of the screwdriver 12. This plane substantially bisects the angle between the guided surfaces, and is normal to the second surfaces of the step. Since the shank is centered between the first faces when clamped therebetween and the blocks are substantially identical, the planes defined by the guided surfaces intersect substantially at the longitudinal axis.

When the screwdriver 12 is clamped in the toolholder 10, the guided surface 102 of one of the second faces 64 is flatly engaged with the surfaces 51 of the rest 45 and the corresponding surface 103 is placed in parallel engagement with the surface 53 of the rest. When so engaged, the surfaces of the toolholder are disposed in normal relation to a common plane which is normal to the rotational axis 43. The toolholder is then moved in a direction parallel to the rotational axis to engage the side 26 of the blade 25 corresponding to this one face with one of the edges 42 of the wheel 40. The movement of the toolholder is continued to traverse this side of the blade across the periphery 41 of the wheel, thereby shaping this side in a cylindrically concave, hollow-ground configuration by grinding engagement with the periphery. This configuration conforms to such periphery, as shown in FIG. 1. The described engagement of the toolholder and the rest ensures that the toolholder and the screwdriver clamped therein are guided slidably on the rest by the engaged surfaces in a direction parallel to the rotational axis.

With the toolholder 10 and the screwdriver 12 clamped together, they are removed from the rest 45 and inverted in relation to the rest. The surfaces 102 and 103 of the one of the second faces 64 corresponding to the other of the sides 26 are then engaged, respectively, with the surfaces 51 and 53 of the rest. The toolholder and screwdriver are moved across the wheel 40 while being guided by these engaged surfaces to grind this other side also in a cylindrically concave, hollow-ground configuration. Since the surfaces of both V-shaped grooves 80 are normal to a common plane of reference, the axes of the cylindrically concave sides of the blades are necessarily substantially parallel. One side of the blade is thus shaped by the grinder 14 when one of the guided surfaces 102 is engaged with the guiding surface 51 and the other side of the blade is shaped by the grinder when the other of the guided surfaces is engaged with the guiding surface, the screwdriver moving in linear sliding movement parallel to the guiding surface and the rotational axis 43 as each side is shaped. As each side of the blade is shaped, engagement of the corresponding one of the surfaces 103 of the toolholder 10 with the stop surface 53 maintains the toolholder at the proper spacing from the wheel 40.

When both of the sides 26 have been hollow ground, the toolholder 10 is removed from the rest 45 and the thumbscrews 121 are loosened sufficiently that the screwdriver 12 can be slid in relation to the blocks 61 in a direction along its axis 20 while being maintained in transverse alignment with the blocks by the grooves 80 or by one of the surfaces 85, depending on the shape of the shank as previously described. The screwdriver is slid to a position, shown in FIG. 6, such that when one of the second surfaces 133 is engaged with the stop surface 53 of the rest, the tip surface 28 projects slightly beyond the periphery 41 of the wheel 40. The thumbscrews are then adjustably tightened in the manner previously described, to clamp the screwdriver between the blocks and to bring the faces 63 of the blocks into parallel relation. Next, the surfaces 132 and 133 of the step are engaged flatly with, respectively, the surfaces 51 and 53 for guidance of the toolholder thereby in sliding movement in a direction parallel to these surfaces and to the rotational axis 43. The toolholder is then moved in this direction to engage the blade with the wheel and shape the tip surface by grinding thereon. When the tip surface has been shaped, the thumbscrews are loosened and the screwdriver removed for use.

As shown in FIG. 6, the toolholder 10 is adapted for use with a wheel dressing tool 140, depicted in dash lines. This tool is of conventional construction, and is provided with a diamond tip 141. The dressing tool is placed in the V-shaped grooves 80 and clamped between the blocks 61 in a position relative thereto similar to the position in which the screwdriver is disposed to shape the tip surface 28. The toolholder is then guided in sliding movement by engagement with the rest in the manner in which the toolholder is guided to shape the tip surface of the screwdriver so that the diamond point dresses the periphery 41 of the wheel 40 into parallel relation with the surfaces 51 and 53 of the rest 45 and with the rotational axis 43.

It is thus apparent that the toolholder 10 is adapted for use with a conventional grinder 14 to shape both sides 26 of the blade 25 of a screwdriver 12 or the like in a substantially identical, cylindrically concave, hollow-ground configuration, the toolholder being guided by the rest 45 and having no parts which move relatively while the blade is shaped. The toolholder is adapted for use with a shank having a variety of cross-sectional configurations and, by positioning the shank 22 axially in relation to blocks 61 and/or adjusting the rest in relation to the wheel 40, the blades of screwdrivers of a wide range of lengths and sizes can be given a hollow-ground configuration. The toolholder is also adapted for use in accurately shaping the tip surface of the blade and the periphery of the wheel.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A toolholder for use with a tool shaping device having a planar guiding surface and with a tool having a pair of opposite sides which are individually shaped by linear movement of the tool in a direction parallel to the surface, the holder comprising:

A. a body having a pair of juxtaposed blocks adapted to receive the tool therebetween and individually bearing a pair of faces disposed oppositely of the body and individually corresponding to the sides of the tool, each face having a planar guided surface adapted to engage flatly the guiding surface of the shaping device for guidance of the body in sliding movement in said direction, and having a pair of portions disposed so as to be spaced in said direction when the guided surface of the blade is engaged with the guided surface for such guidance;

B. means for clamping the tool in the body centrally between the faces so that one side of the tool is shaped by the device when one of the guided surfaces engages the guiding surface and the other side of the tool is shaped by the device when the other of the guided surfaces engages the guiding surface, the clamping means including a pair of spaced, screwthreaded elements, each element individually connecting one portion of one block with the portion of the other block corresponding to said one portion along said direction when the guided surface of the blade is engaged with the guided surface for such guidance, so that rotation of the element in a predetermined direction urges the pair of portions associated therewith toward each other and so that selective rotation of the screwthreaded elements in said direction of rotation adjusts the guided surfaces precisely into normal relation to a plane of reference which is normal to said direction; and C. means for indicating the relative spacing of the pair of portions of the blocks associated with one of the screw-threaded elements and means for indicating the relative spacing of the pair of portions of the blocks associated with the other of the screw-threaded elements, each indicating means indicating the relative spacing of the pair of portions associated with the screw-threaded element of said means when the guided surfaces are disposed precisely in said normal relation.

2. The toolholder of claim 1 wherein the shaping device has a planar surface parallel to said direction of linear movement and the tool has an end extending between the opposite sides thereof and wherein:

A. said guided surfaces are convergent when in said normal relation; and

B. one of the blocks is provided with a planar surface substantially normal to a plane of reference bisecting the angle between the guided surfaces and adapted to engage flatly the planar surface of the shaping device for guidance of the toolholder in sliding movement in a direction along said surface of the shaping device, thereby guiding the holder for shaping of said end of the tool.

3. In combination, a device having a tool shaping element provided with a cylindrical periphery and adapted to rotate about the axis thereof and having a rest providing a planar guiding surface parallel to the axis; a tool having a shank extended along a longitudinal axis and having a pair of opposite sides to be shaped by engagement with the periphery in substantially identical, cylindrically concave configurations conforming to the periphery and disposed symmetrically and oppositely of the longitudinal axis; and a toolholder comprising:

A. a pair of juxtaposed blocks, each block having a first face disposed toward the other block so as to engage the tool between said face and the first face of the other block with the tool extended from between the first faces with one of the sides of the tool disposed toward the axis and having a second face disposed oppositely of the other of the blocks providing a planar guided surface adapted flatly to engage the guiding surface of the rest and guide the block in sliding movement parallel to the axis to engage said one side with the edge;

B. means for maintaining the blocks in said juxtaposed relation in a direction along the axis; and C. means for drawing the blocks toward each other into clamping relation with the tool so that, when said one side is shaped in such a concave configuration by engagement with the periphery, the blocks and the tool are invertible together in relation to the rest and the side of the tool opposite said one side subsequently shaped in such a concave configuration with the guided surface of said other block engaged in guiding relation with the guiding surface D. each said block having a pair of opposite ends which are spaced in a direction along the axis when said guided surfaces are engaged with the guiding surface, the opposite ends of one block being disposed in individually adjacent relation to the corresponding ends of the other block;

E. the means for drawing the blocks toward each other comprises a pair of clamps individually related to the adjacent pairs of the ends for adjustably positioning the ends of each pair toward and from each other; and F. the toolholder further comprises a pair of measuring elements individually related to the adjacent pairs of the ends and indicating the relative positions of the adjacent pairs of ends toward and from each other so as to indicate that the guided surfaces are substantially normal to a common plane of reference which is normal to the axis when one of said guided surfaces is flatly engaged with the guiding surface, whereby the cylindrically concave sides of the tool are shaped so that their respective axes are substantially parallel.

4. The toolholder for use in shaping a screwdriver or the like with a grinder, the screwdriver includes a shank elongated along a longitudinal axis and a blade mounted on one end of the shank and having opposite sides disposed oppositely of the axis and the grinder including a grinding wheel mounted for rotation about a rotational axis substantially conicident with the axis of the wheel and a rest providing a stationary, planar guiding surface parallel to the rotational axis, wherein the toolholder comprises:

A. a pair of elongated blocks disposed in facing, juxtaposed relation and adapted to receive the shank therebetween and longitudinally centrally thereof in a predetermined disposition in which the longitudinal axis extends transversely of the blocks with the blade spaced transversely from the blocks, each block including (1) a pair of longitudinally opposite ends, (2) a transverse side disposed toward the blade when the shank is received in said predetermined disposition, (3) a first face disposed toward the other of the blocks, (4) a second face disposed oppositely of the other of the blocks bearing an elongated planar guided surface extended longitudinally of the block between the ends thereof and adapted flatly to engage the guiding surface of the rest to guide the blocks in sliding movement parallel to the rotational axis, said guided surface and the guided surface of the other block converging in a direction away from the transverse side and being disposed so as substantially to intersect at the longitudinal axis when the guided surfaces are in normal relation to a reference plane including the longitudinal axis, and (5) a notch disposed at one of the ends and extended through the block in a direction between the faces thereof;

B. means extended from one of the blocks and slidably engaged with the other block for restraining the blocks against relative longitudinal movement;

C. a pair of thumbscrews spaced longitudinally of the blocks and extended therethrough oppositely of the shank when the shank is received in said predetermined disposition, each thumbscrew having a head disposed oppositely of one of the blocks from the other of the blocks and having a shank screw-threadably connected to said other of the blocks so that tightening of the thumbscrew draws together the portions of each block through which the thumbscrew extends and brings the blocks into clamping engagement with the shank of the screwdriver;

D. a first projection fixedly mounted on one end of one of the blocks and extended from said one end toward the other of the blocks, the projection bearing indicia indicating the distance at said one end of said one block from the first face thereof to the first face of the other of the blocks; and E. a second projection fixedly mounted on an end of one of the blocks opposite the end mounting the first projection, the second projection extending toward the adjacent end of the other of the blocks and bearing indicia indicating the distance at the end mounting the second projection from the first face of the block mounting the second projection to the first face of the other of the blocks, whereby the distance between the first faces at the longitudinally adjacent ends of the blocks can be equalized by selective tightening of the thumbscrews to bring the guided surfaces into said normal relation.

5. The toolholder of claim 4 wherein the ends of the blocks adjacent to the ends thereof mounting the first projection and the second projection have individual notches extended between the corresponding first face and the corresponding second face to receive the longitudinally corresponding one of the projections as the blocks are brought into said clamping engagement.

6. The toolholder of claim 4 wherein the rest has a planar surface parallel to the rotational axis and extended from the guiding surface in right-angular relation thereto oppositely therefrom the wheel, and wherein:

A. the guided surface of each block is one of the surfaces of a V-shaped channel extended longitudinally of the block oppositely of the thumbscrews from the transverse side of the block; and B. the other surfaces of said channel is planar and is disposed for slidable engagement with the surface extended from the guiding surface when the corresponding guided surface is flatly engaged with the guiding surface to maintain the toolholder at a predetermined spacing from the wheel.

7. The toolholder of claim 6 wherein the blade has a tip surface interconnecting the opposite sides thereof, and wherein each block has a longitudinally extending step spaced toward the transverse side of the block from the thumbscrews, the step providing a first surface which is substantially parallel to the rotational axis when the screwdriver is received in said predetermined disposition and providing a second surface which is substantially normal to the longitudinal axis when the screwdriver is so received, said first surface and said second surface being adapted, respectfully, to engage the guiding surface of the rest and the surface thereof extended from the guiding surface thereby to guide the holder in sliding motion parallel to the rotational axis with the tip surface engaged with the wheel.

* * * * *